US007938915B2

(12) United States Patent
Kanekiyo et al.

(10) Patent No.: US 7,938,915 B2
(45) Date of Patent: May 10, 2011

(54) RARE EARTH ALLOY BINDERLESS MAGNET AND METHOD FOR MANUFACTURE THEREOF

(75) Inventors: Hirokazu Kanekiyo, Osaka (JP); Toshio Miyoshi, Osaka (JP); Katsunori Bekki, Osaka (JP); Ikuo Uemoto, Osaka (JP); Kazuo Ishikawa, Mie (JP)

(73) Assignees: Hitachi Metals, Ltd., Tokyo (JP); Nippon Kagaku Yakin Co., Ltd., Osaka (JP)

( * ) Notice: Subject to any disclaimer, the term of this patent is extended or adjusted under 35 U.S.C. 154(b) by 499 days.

(21) Appl. No.: 12/063,150

(22) PCT Filed: Aug. 3, 2006

(86) PCT No.: PCT/JP2006/315409
§ 371 (c)(1),
(2), (4) Date: Feb. 7, 2008

(87) PCT Pub. No.: WO2007/018123
PCT Pub. Date: Feb. 15, 2007

(65) Prior Publication Data

US 2009/0127494 A1 May 21, 2009

(30) Foreign Application Priority Data

Aug. 8, 2005 (JP) ..... 2005-229555
Nov. 4, 2005 (JP) ..... 2005-321452

(51) Int. Cl.
*H01F 1/053* (2006.01)

(52) U.S. Cl. ..... 148/101; 148/104; 148/302

(58) Field of Classification Search ..... None
See application file for complete search history.

(56) References Cited

U.S. PATENT DOCUMENTS

| | | | | |
|---|---|---|---|---|
| 4,710,239 | A * | 12/1987 | Lee et al. | 148/101 |
| 4,829,277 | A * | 5/1989 | Stahura et al. | 335/306 |
| 5,026,438 | A * | 6/1991 | Young et al. | 148/101 |
| 6,599,465 | B1 | 7/2003 | Reppel et al. | |
| 2004/0025974 | A1 | 2/2004 | Lee et al. | |
| 2004/0099346 | A1 * | 5/2004 | Nishiuchi et al. | 148/302 |
| 2005/0008838 | A1 | 1/2005 | Ohshima et al. | |
| 2005/0233068 | A1 | 10/2005 | Yoshimura et al. | |

FOREIGN PATENT DOCUMENTS

| | | |
|---|---|---|
| JP | 63-192205 A | 8/1988 |
| JP | 04-323803 A | 11/1992 |

(Continued)

OTHER PUBLICATIONS

Official Communication issued in International Patent Application No. PCT/JP2006/315409, mailed on Oct. 24, 2006.

(Continued)

*Primary Examiner* — John P Sheehan
(74) *Attorney, Agent, or Firm* — Keating & Bennett, LLP

(57) ABSTRACT

A method for producing a rare-earth alloy based binderless magnet according to the present invention includes the steps of: (A) providing a rapidly solidified rare-earth alloy magnetic powder; and (B) compressing and compacting the rapidly solidified rare-earth alloy magnetic powder by a cold process without using a resin binder, thereby obtaining a compressed compact, 70 vol % to 95 vol % of which is the rapidly solidified rare-earth alloy magnetic powder.

5 Claims, 4 Drawing Sheets

FOREIGN PATENT DOCUMENTS

| | | | |
|---|---|---|---|
| JP | 05-135978 | A | 6/1993 |
| JP | 07-240307 | A | 9/1995 |
| JP | 10-270236 | A | 10/1998 |
| JP | 2000-348919 | A | 12/2000 |
| JP | 2004-14906 | A | 1/2004 |
| JP | 2004-349585 | A | 12/2004 |
| JP | 2005-171264 | A | 6/2005 |
| JP | 2005-527989 | A | 9/2005 |
| WO | 2004/015723 | A2 | 2/2004 |

OTHER PUBLICATIONS

English translation of the official communication issued in counterpart International Application No. PCT/JP2006/315409, mailed on Feb. 21, 2008.

Official Communication issued in corresponding Japanese Patent Application No. 2007-529533, mailed on Nov. 30, 2010.

* cited by examiner

RARE EARTH ALLOY BINDERLESS MAGNET AND METHOD FOR MANUFACTURE THEREOF

BACKGROUND OF THE INVENTION

1. Field of the Invention

The present invention relates to a rare-earth alloy based binderless magnet and a method for producing such a magnet. More particularly, the present invention relates to a magnet produced by compacting a powder of a rapidly solidified rare-earth magnetic alloy under an ultrahigh pressure.

2. Description of the Related Art

Bonded magnets, obtained by adding a resin binder to a magnetic powder of a rapidly solidified rare-earth alloy, achieve high size precision and show great flexibility in shape, and have been used extensively in various types of electronic devices and electric components. However, the thermal resistant temperature of such a bonded magnet is restricted by not only the thermal resistant temperature of the magnetic powder used but also that of the resin binder used to bind the magnetic powder. As for a compressed bonded magnet that uses a thermosetting epoxy resin, for example, the thermosetting epoxy resin has a low heat resistant temperature, and therefore, the maximum allowable temperature, at which the magnet can be used in normal condition, is as low as approximately 100° C. at most. Besides, since a bonded magnet includes an electrically insulating resin binder, it is difficult to carry out a surface treatment such as electrical plating or an evaporation and deposition process of a metal coating.

On top of that, a normal bonded magnet includes a resin binder, and the volume fraction of its magnetic powder cannot be increased to more than 83 vol %. Since the resin binder does not contribute to expressing properties as a magnet, the resultant magnetic properties of a bonded magnet cannot but be lower than those of a sintered magnet.

It should be noted that even in a compressed bonded magnet including a magnetic powder at a relatively high volume fraction, the volume fraction of the magnetic powder is approximately 83 vol % at most and the maximum energy product thereof can be no greater than about 96 kJ/m$^3$ (=12 MGOe).

Recently, very small ringlike magnets with a diameter of 10 mm or less have often been used in small spindle motors, stepper motors and various types of small sensors. In those applications, there is a high demand for permanent magnets with excellent compactibility and improved magnetic properties. That is to say, the magnetic properties of conventional bonded magnets are not enough in those applications more and more often.

A full-dense magnet is known as a magnet including a higher volume fraction of magnetic powder than a bonded magnet. Patent Document No. 1 discloses a full-dense magnet made of a rapidly solidified nanocomposite alloy. Such a full-dense magnet is produced by compressing, and increasing the density of, a magnetic powder of a rapidly solidified alloy without using a resin binder.

Patent Document No. 2 discloses that a nanocomposite magnetic powder is compressed and compacted at a temperature of 550° C. to 720° C. with a pressure of 20 MPa to 80 MPa applied. The density of a full-dense magnet obtained in this manner can be as high as 92% or more of the true density of the magnet.

Patent Document No. 3 discloses a binderless magnet with a magnetic powder purity of 99%, which is coated with a wrapping material. And Patent Document No. 4 discloses a compressed powder magnetic core made of a nanocrystalline magnetic powder.

Patent Document No. 1: Japanese Patent Application Laid-Open Publication No. 2004-14906

Patent Document No. 2: Japanese Patent Application Laid-Open Publication No. 2000-348919

Patent Document No. 3: Japanese Patent Application Laid-Open Publication No. 10-270236

Patent Document No. 4: Japanese Patent Application Laid-Open Publication No. 2004-349585

The full-dense magnet disclosed in Patent Document No. 1 includes a magnetic powder at a high volume fraction and is expected to exhibit better magnetic properties than a bonded magnet. However, since the magnet is produced by a hot pressing technology such as a hot-press process, the press cycle is too long to achieve good mass productivity. As a result, the manufacturing cost of the magnets will increase, thus making it difficult to mass-produce such magnets in practice.

The magnet disclosed in Patent Document No. 2 is produced by heating the magnetic powder to a high temperature and compressing it by spark plasma sintering, for example. This process also has too long a press cycle to achieve good mass productivity.

Patent Document No. 3 discloses no specific manufacturing process, and it is not clear how such a high magnetic powder volume fraction is realized. Also, in the compressed powder magnetic core disclosed in Patent Document No. 4, the magnetic powder particles themselves are bound together with glass. The volume fraction of that glass would be approximately equal to that of a resin binder in a conventional bonded magnet.

As can be seen, any of these conventional techniques for compacting a magnetic powder without using a resin binder achieves either just low mass productivity or a magnetic powder volume fraction that is essentially no different from that of a bonded magnet.

Meanwhile, to produce a sintered magnet in which magnetic powder particles have been bound together with substantially no voids left, a sintering process must be performed at as high a temperature as 1,000° C. to 1,200° C. In the sintering process, a liquid phase is formed and a grain boundary phase, including a rare-earth rich phase, is also produced. The grain boundary phase plays an important role to produce coercivity. However, the green compact will shrink significantly during the sintering process. That is to say, since the compact changes its shapes significantly after the press compaction process, the size precision and flexibility in shape of a sintered magnet are much inferior to those of a bonded magnet.

SUMMARY OF THE INVENTION

In order to overcome the problems described above, the present invention has an object of providing a magnet that will achieve high size precision and show great flexibility in shape and yet exhibit higher thermal resistance and better magnetic properties than a bonded magnet.

A rare-earth alloy based binderless magnet according to the present invention is a magnet in which magnetic powder particles of a rapidly solidified rare-earth alloy are bound together without a resin binder. The magnetic powder of the rapidly solidified rare-earth alloy accounts for 70 vol % to 95 vol % of the entire magnet.

In one preferred embodiment, the magnetic powder particles of the rapidly solidified alloy are bound together with substances that have segregated from the magnetic powder particles of the rapidly solidified alloy.

In a specific preferred embodiment, the magnetic powder particles of the rapidly solidified alloy are made of an iron-based rare-earth alloy including boron and the segregated substances include at least one element selected from the group consisting of iron, the rare-earth elements and boron.

In another preferred embodiment, the magnetic powder particles of the rapidly solidified alloy have cracks and at least a portion of the segregated substances is present in the cracks.

In still another preferred embodiment, the magnetic powder of the rapidly solidified rare-earth alloy accounts for more than 70 vol % to less than 92 vol % of the entire magnet.

In yet another preferred embodiment, the magnetic powder particles of the rapidly solidified rare-earth alloy are bound together by a solid-phase sintering process.

In yet another preferred embodiment, the magnetic powder particles of the rapidly solidified rare-earth alloy include at least one type of ferromagnetic crystalline phase with an average grain size of 10 nm to 300 nm.

In yet another preferred embodiment, the magnetic powder particles of the rapidly solidified rare-earth alloy have a nano-composite magnet structure including a hard magnetic phase and a soft magnetic phase.

In a specific preferred embodiment, the magnet has a density of 5.5 g/cm$^3$ to 7.0 g/cm$^3$.

Another rare-earth alloy based binderless magnet according to the present invention has a composition represented by the compositional formula: $T_{100-x-y-z}Q_xR_yM_z$, where T is a transition metal element including Fe with or without at least one element selected from the group consisting of Co and Ni; Q is at least one element selected from the group consisting of B and C; R is at least one rare-earth element including substantially no La and substantially no Ce; and M is at least one metallic element selected from the group consisting of Ti, Al, Si, V, Cr, Mn, Cu, Zn, Ga, Zr, Nb, Mo, Ag, Hf, Ta, W, Pt, Au and Pb; and where the mole fractions x, y and z satisfy: 10 at %$<x\leqq$35 at %; 2 at %$\leqq y\leqq$10 at %; and 0 at %$\leqq z\leqq$10 at %.

Another rare-earth alloy based binderless magnet according to the present invention has a composition represented by the compositional formula: $T_{100-x-y-z}Q_xR_yM_z$, where T is a transition metal element including Fe with or without at least one element selected from the group consisting of Co and Ni; Q is at least one element selected from the group consisting of B and C; R is at least one rare-earth element including substantially no La and substantially no Ce; and M is at least one metallic element selected from the group consisting of Ti, Al, Si, V, Cr, Mn, Cu, Zn, Ga, Zr, Nb, Mo, Ag, Hf, Ta, W, Pt, Au and Pb; and where the mole fractions x, y and z satisfy: 4 at %$<x\leqq$10 at %; 6 at %$\leqq y<$12 at %; and 0 at %$\leqq z\leqq$10 at %.

A method for producing a rare-earth alloy based binderless magnet according to the present invention includes the steps of: (A) providing a rapidly solidified rare-earth alloy magnetic powder; (B) compressing and compacting the rapidly solidified rare-earth alloy magnetic powder by a cold process without using a resin binder, thereby obtaining a compressed compact, 70 vol % to 95 vol % of which is the rapidly solidified rare-earth alloy magnetic powder; and (C) subjecting the compressed compact to a heat treatment process at a temperature of 350° C. to 800° C. after the step (B) has been performed.

In one preferred embodiment, the step (B) includes compressing the rapidly solidified rare-earth alloy magnetic powder under a pressure of 500 MPa to 2,500 MPa.

In this particular preferred embodiment, the step (C) includes conducting the heat treatment process within an inert atmosphere with a pressure of $1\times10^{-2}$ Pa or less.

In another preferred embodiment, the step (C) includes conducting the heat treatment process within an inert gas atmosphere with a dew point of −40° C. or less.

A magnetic circuit component according to the present invention includes: any of the rare-earth alloy based binderless magnets described above; and a resin-less compressed powder magnetic core in which powder particles of a soft magnetic material are bound together without a resin binder. The binderless magnet and the resin-less compressed powder magnetic core are combined together.

In one preferred embodiment, in the resin-less compressed powder magnetic core, the powder particles of the soft magnetic material have been bound together by a sintering process.

In another preferred embodiment, the binderless magnet and the resin-less compressed powder magnetic core have been bound together by a sintering process.

A magnetic circuit component making method according to the present invention is a method of making the magnetic circuit component described above and includes the steps of: (A) providing a rapidly solidified rare-earth alloy powder and a soft magnetic material powder; (B) compressing the rapidly solidified rare-earth alloy powder and the soft magnetic material powder by a cold process under a pressure of 500 MPa to 2,500 MPa, thereby making a compact in which these two powders are combined together; and (C) subjecting the compressed and combined compact to a heat treatment process at a temperature of 350° C. to 800° C.

In one preferred embodiment, the step (A) includes making a green compact of at least one of the rapidly solidified rare-earth alloy powder and the soft magnetic material powder, and the step (B) includes compressing the rapidly solidified rare-earth alloy power and the soft magnetic material powder including the green compact at least partially.

As used herein, the "compressed compact" means a powder compact obtained by compressing and compacting a magnetic powder of a rapidly solidified rare-earth alloy and/or a soft magnetic powder by a cold process. Also, the "binderless magnet" and "resin-less compressed powder magnetic core" refer herein to compacts in which powder particles are bound together without a resin binder by thermally treating a magnetic powder and a compressed compact of a soft magnetic powder, respectively. Furthermore, the "green compact" will refer herein to an aggregation of powder particles yet to be compressed and compacted by a cold process, irrespective of its density. A powder yet to be compressed and compacted by a cold process may assume the shape of such a green compact. According to the present invention, no resin binder is used, and the heat resistant temperature of the magnet is not restricted by that of any resin binder, thus achieving good thermal resistance. In addition, since there is no need to perform the process step of mixing and kneading a magnetic powder and a resin binder together, the manufacturing cost can be cut down, too.

Besides, according to the present invention, the magnet includes a higher volume fraction of magnetic powder than a bonded magnet, and therefore, achieves better magnetic properties than the bonded magnet. Consequently, even a small-sized magnet with a diameter of 4 mm or less, which would be hard to exhibit good enough magnetic properties if the magnet is a bonded magnet, can also exhibit excellent properties as a magnet according to the present invention.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Figure 1:
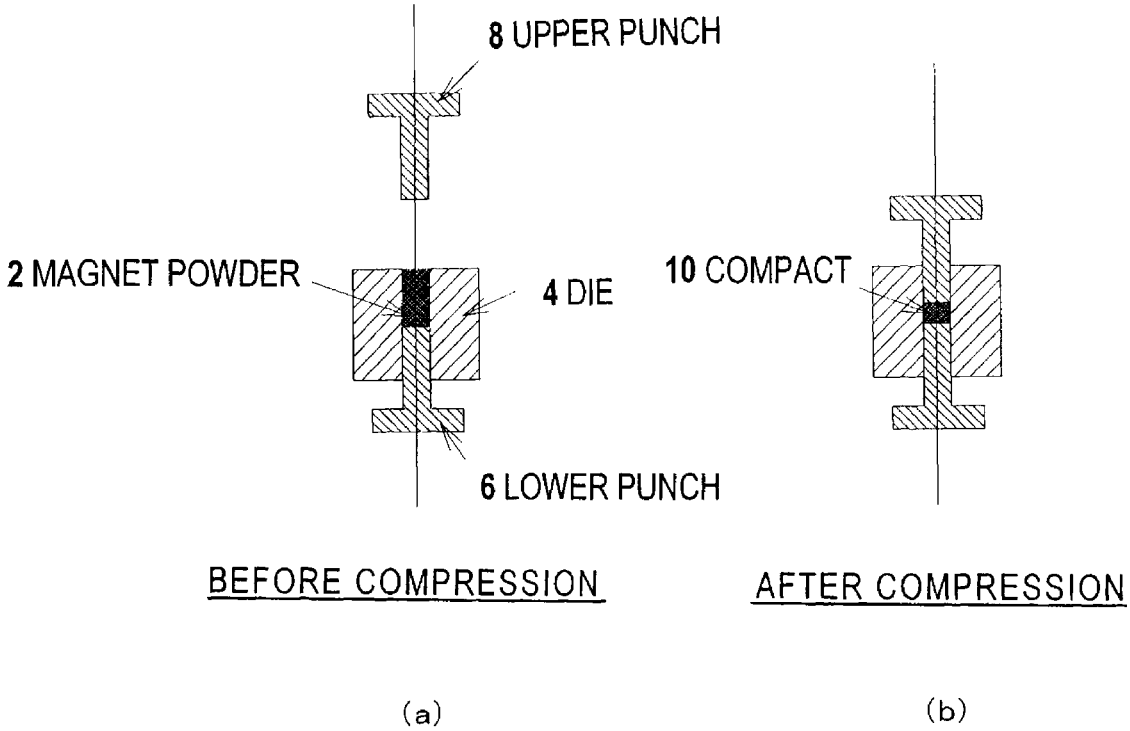
FIGS. 1(*a*) and 1(*b*) show an exemplary configuration for a compression/compaction machine that can be used effectively to make a binderless magnet according to the present invention.

A rare-earth alloy based binderless magnet according to the present invention is a magnet in which magnetic powder particles of a rapidly solidified rare-earth alloy are bound together without a resin binder. And the magnetic powder of the rapidly solidified rare-earth alloy accounts for 70 vol % to 95 vol % of the entire magnet. The magnetic powder particles of this rapidly solidified rare-earth alloy are bound together by a cold press (cold compression) process at an ultrahigh pressure, not by a normal high-temperature sintering or hot press process. As used herein, the "cold press" means performing a compression/compaction process with no heat applied to the die or punches of a press machine. More specifically, the cold press means compressing and compacting a powder at a temperature (of 500° C., for example, and typically 100° C. or less) at which no hot compaction can be done.

To bind the magnetic powder particles of a rapidly solidified rare-earth alloy together firmly without using any resin binder and compact them into a bulk, it has been believed that a hot compaction process such as a hot press process or a high-temperature sintering process should be carried out as described above. Particularly in processing powder particles with an extremely high hardness such as those of an Nd—Fe—B based quenched magnet, it has been commonly believed that the compaction process must be carried out with a sintering process for forming a liquid phase advanced by heating the powder particles being compressed and compacted to a high temperature exceeding 800° C.

However, contrary to this popular misconception, the present inventors tried compressing and compacting magnetic powder particles of rapidly solidified rare-earth alloy in various manners by a cold process. As a result, the present inventors discovered that if the process was carried out with higher precision after the material of a die assembly for use in the compression process had been selected appropriately, even those magnetic powder particles of a rapidly solidified rare-earth alloy that have high hardness could be compressed and compacted by a cold process under an ultrahigh pressure of 500 MPa to 2,500 MPa. And we also discovered that a binderless magnet could be obtained by advancing a sintering process after that at as low a temperature as 350° C. to 800° C. and that the binderless magnet obtained in this manner could still exhibit excellent properties as a magnet, thus perfecting our invention. This temperature range is much lower than a temperature (typically as high as 1,000° C. or even more) at which a powder compact of a ceramic, for example, needs to be sintered in a solid phase by a conventional process or a temperature at which a rare-earth sintered magnet needs to be sintered in a liquid phase by a conventional process. By performing such a low-temperature sintering process, a binderless magnet can be obtained without allowing the crystal grains to grow excessively.

The present inventors tried to figure out the reason why the sintering process could be carried out at such an unexpectedly low temperature, which had been unthinkable in the prior art, by performing a cold compression and compaction process under an ultrahigh pressure that had not been done successfully by anybody in the past. As a result, we discovered that an ingredient that had come from the magnetic powder particles of the rapidly solidified alloy had segregated between the respective magnetic powder particles of the rapidly solidified alloy forming the binderless magnet and that the respective powder particles were bound together with this substance that segregated from the magnetic powder particles. We also discovered that some cracks had been caused in the magnetic powder particles of the rapidly solidified alloy as a result of the cold compression and compaction process under the ultrahigh pressure but that those cracks had also been filled with a similar segregated substance.

According to the present invention, the surface and inside of the magnetic powder particles of the rapidly solidified alloy will cause cracks as a result of the cold compression process under an ultrahigh pressure, thus newly exposing very active fractures at the surface and inside of the magnetic powder particles of the rapidly solidified alloy. If those cracks were left as they are, the resultant mechanical strength would be insufficient. According to the present invention, however, a heat treatment process is carried out at a relatively low temperature after the compression process has been done at that ultrahigh pressure, thereby segregating that ingredient, coming from the magnetic powder particles of the rapidly solidified alloy, through the newly exposed fractures. And such a segregated substance would contribute greatly to binding the powder particles together. Such a different ingredient would be segregated according to the composition of the quenched alloy magnet. According to the results of experiments the present inventors carried out, the segregated substance included at least one of Fe, boron and the rare-earth elements.

Nevertheless, very small voids are still left between the particles that have been bound together by the ultrahigh pressure compression process and the heat treatment process. And those voids account for 5 vol % to 30 vol % of the overall compacted magnet. Optionally, after the compression and compaction process, some of those voids may be filled with either a resin or a low-melting metal such as zinc, tin or Al—Mn in order to close the holes, for example. However, the amount of such a resin or low-melting metal preferably accounts for less than 15 wt %, more preferably less than 10 wt % and even more preferably less than 8 wt % of the entire magnet body. Such a small amount of resin or low-melting metal does not function as a major binder. The magnetic powder particles of the rapidly solidified alloy that form the magnet body of the present invention are bound together mainly with the segregated substance described above.

In a conventional rare-earth sintered magnet produced by a high-temperature sintering process, the crystal grains functioning as a main phase are made of an Nd—Fe—B based compound with hard magnetic properties. Meanwhile, since a grain boundary phase of a non-magnetic material is present between the crystal grains, there are almost no voids in the rare-earth sintered magnet. It is known that to exhibit high coercivity, it is very important for such a rare-earth sintered magnet to have a nucleation type mechanism of generating magnetic properties, by which the main phase crystal grains are partitioned with the grain boundary phase.

On the other hand, in the rare-earth alloy based binderless magnet of the present invention, no alloy functioning as a grain boundary phase is present between the respective powder particles that have been bound together. And yet the magnet of the present invention can still exhibit high coercivity because the average crystal grain size of the microstructure of the magnetic powder particles for use in the binderless magnet has been adjusted to a single magnetic domain size or less. If the average grain size is equal to or smaller than the single magnetic domain size, each crystal grain will have a single magnetic domain structure. As a result, intrinsic coercivity is not exhibited by the nucleation type mechanism that requires a multi-magnetic domain structure as is often seen in an Nd—Fe—B based sintered rare-earth magnet but by a nanocrystalline mechanism of generating the magnetic property in which respective crystal grains in single magnetic domains are bound together via exchange interactions. Consequently, even without performing a sintering process at a high temperature that is equal to or higher than the liquid phase sintering temperature as in a conventional rare-earth sintered magnet, high intrinsic coercivity and good loop squareness of a demagnetization curve are realized because no grain boundary needs to be formed by the liquid phase sintering process.

According to the present invention, a nanocomposite magnetic powder with a nanometer-scale average grain size or a rapidly solidified amorphous alloy powder, in which a nanometer-scale fine crystal structure is formed by a heat treatment process for crystallization, can be used effectively.

A magnetic powder available from Magnequench International (MQI), Inc., which is so-called "MQ powder", may also be used as a magnetic powder according to the present invention. However, as the MQ powder includes a rare-earth-rich phase, a rare-earth oxide could be formed during the sintering process and the magnetic powder particles could not be bound easily. That is why to sinter such a magnetic powder, the sintering process is preferably carried out in a vacuum of $10^{-2}$ Pa or less.

On the other hand, a nanocomposite magnet including a hard magnetic phase and soft magnetic phases have no rare-earth-rich phases, and therefore, can be thermally treated without oxidizing the rare-earth element even in an inert atmosphere after the magnetic powder has been compressed and compacted under an ultrahigh pressure by a cold process. The heat treatment process after the compression and compaction process is not indispensable. However, by performing such a heat treatment process, the magnet body that has been compressed and compacted under an ultrahigh pressure by a cold process can have even higher mechanical strength. For that reason, a nanocomposite magnetic powder with a small rare-earth content is preferably used to make the rare-earth binderless magnet of the present invention.

As such a nanocomposite magnetic powder, a rare-earth nanocomposite magnetic powder, of which the composition is represented by the compositional formula $T_{100-x-y-z}Q_xR_yM_z$, can be used effectively. In this formula, T is a transition metal element including Fe with or without at least one element selected from the group consisting of Co and Ni; Q is at least one element selected from the group consisting of B and C; R is at least one rare-earth element including substantially no La and substantially no Ce; and M is at least one metallic element selected from the group consisting of Ti, Al, Si, V, Cr, Mn, Cu, Zn, Ga, Zr, Nb, Mo, Ag, Hf, Ta, W, Pt, Au and Pb; and the mole fractions x, y and z satisfy: 10 at %$<x\leqq$35 at %; 2 at %$\leqq y\leqq$10 at %; and 0 at %$\leqq z\leqq$10 at %, respectively.

In a nanocomposite magnetic powder with such a composition, the hard magnetic phase of the magnet is crystal grains of an $R_2Fe_{14}B$ type compound and the soft magnetic phase thereof is crystal grains of an iron-based boride or α-Fe. Such a nanocomposite magnetic powder is obtained by rapidly cooling and solidifying a melt of an alloy with the composition described above by a melt-quenching process.

Also, according to the present invention, a nanocomposite magnet including an α-Fe phase as its main soft magnetic phase or an $R_2Fe_{14}B$ single-phase magnet including a little rare-earth-rich phase on the grain boundary may also be used. As such a nanocomposite magnet, a rare-earth nanocomposite magnetic powder, of which the composition is represented by the compositional formula $T_{100-x-y-z}Q_xR_yM_z$, can be used effectively. In this formula, T is a transition metal element including Fe with or without at least one element selected from the group consisting of Co and Ni; Q is at least one element selected from the group consisting of B and C; R is at least one rare-earth element including substantially no La and substantially no Ce; and M is at least one metallic element selected from the group consisting of Ti, Al, Si, V, Cr, Mn, Cu, Zn, Ga, Zr, Nb, Mo, Ag, Hf, Ta, W, Pt, Au and Pb; and the mole fractions x, y and z satisfy: 4 at %$<x\leqq$10 at %; 6 at %$\leqq y<$12 at %; and 0 at %$\leqq z\leqq$10 at %, respectively.

In the binderless magnet of the present invention, the magnetic powder accounts for 70 vol % to 95 vol % of the entire magnet. To make the magnet of the present invention function as a permanent magnet with better properties than a conventional bonded magnet, the lower limit of this volume fraction is preferably set to be 75 vol % or more. The higher the volume fraction of the magnetic powder, the better the properties of the magnet. For that reason, the lower limit of this volume fraction is more preferably set to be 85 vol % or more. Considering the strength of the binderless magnet, the durability of the die assembly, and the mass productivity, however, the upper limit of the volume fraction of the magnetic powder is preferably 92 vol %, more preferably 90 vol %.

If a magnetic powder including an $R_2Fe_{14}B$ type compound as a main phase is used, the binderless magnet will eventually have a density of 5.5 g/cm$^3$ to 7.0 g/cm$^3$. For the binderless magnet, a preferred density range is 6.3 g/cm$^3$ to 6.7 g/cm$^3$ and a more preferred density range is 6.5 g/cm$^3$ to 6.7 g/cm$^3$. In a compressed bonded magnet that uses a conventional resin binder, the magnet body has an overall density of 5.5 g/cm$^3$ to 6.2 g/cm$^3$. Comparing these two types of magnets, it can be seen that the binderless magnet of the present invention has a higher density and eventually realizes better magnetic properties than the conventional bonded magnet.

It is known that the density of a binderless magnet is easily affected by the particle shape of the magnetic powder used. The ideal packing state that would achieve a high density is supposed to be a state in which the powder particles have an almost equi-dimensional shape and in which fine particles fill the gaps between coarse particles. That is why a twin-peak particle size distribution including a lot of particles with large particle sizes and a lot of particles with relatively small particle sizes is preferred. However, it is difficult to make a powder with such a particle size distribution. Also, particles with small particle sizes could be easily oxidized and deteriorate the magnetic properties during a pulverization process. Therefore, if the percentage of fine powder particles were increased to achieve a higher packing density, the resultant magnetic properties could deteriorate.

On the other hand, the binderless magnet of the present invention is produced by a compression/compaction process under an ultrahigh pressure, and therefore, the particle size distribution of the magnetic powder used does not have to be an ideal one with twin peaks. According to the present invention, the magnetic powder could crack during the compression/compaction process and that cracked fine magnetic powder could fill the gaps between the particles to possibly increase the green density. For that reason, according to the present invention, it is effective to use a magnetic powder that would crack easily. Magnetic powder particles with a flat shape would crack more easily than particles with an isometric shape. According to the present invention, magnetic powder particles with a flat shape are preferably used in order to increase the density of the binderless magnet. More specifically, a magnetic powder, of which the powder particles have an aspect ratio (i.e., the ratio of the minor-axis size of the magnetic powder to the major-axis size thereof) of 0.3 or less, is preferably used. Powder particles with a flat shape tend to have their thickness direction aligned with the compression direction, and therefore, do not create gaps easily between the particles and often has a higher packing density, which is beneficial.

Also, in the binderless magnet of the present invention, the microstructure of the magnetic powder used preferably has an average crystal grain size of 10 nm to 300 nm. This is because if the average grain size were below than the lower limit of this range, the intrinsic coercivity would decrease and because if the average grain size were beyond than the upper limit of this range, then the exchange interactions between the crystal grains would diminish. However, even if the average grain size were greater than the single magnetic domain crystal grain size but 5 μm or less, the magnet can still be used in a particular operating environment (where the magnet has a high operating point).

Manufacturing Process

Hereinafter, a preferred embodiment of a method for producing a rare-earth alloy based binderless magnet according to the present invention will be described.

First, a magnetic powder of a rapidly solidified rare-earth alloy for use to make a binderless magnet according to the present invention is provided. This powder can be obtained by rapidly cooling a molten alloy with the composition described above by a roller quenching process such as a melt spinning process or a strip casting process and then pulverizing the resultant rapidly solidified alloy. The magnetic powder can also be obtained by rapidly cooling the molten alloy by an atomization process, instead of such a roller quenching process. The magnetic powder of the rapidly solidified rare-earth alloy preferably has a mean particle size of at most 300 μm, more preferably in the range of 30 μm to 250 μm and even more preferably in the range of 50 μm to 200 μm. Also, to narrow the gap between the particles and increase the density of the magnet body that has been compressed and compacted, the particle size distribution preferably has two peaks.

Next, the rapidly solidified rare-earth alloy magnetic powder thus obtained is compressed and compacted by a cold process under an ultrahigh pressure. In a preferred embodiment of the present invention, the cold compression/compaction process is carried out at a temperature environment of 500° C. or less, typically 100° C. or less, and therefore, crystallization of the powder particles does not advance during the compression/compaction process. According to the present invention, the powder particles yet to be compressed and compacted may either have been crystallized substantially entirely or include a lot of amorphous portions. If the powder particles include a lot of amorphous phases, a heat treatment process for crystallization is preferably carried out after the ultrahigh pressure compaction process. However, the sintering process to be performed after the ultrahigh pressure compaction process may also substitute for the heat treatment process for crystallization.

To minimize the damage that could be done on the die during the cold compression/compaction process under the ultrahigh pressure, a lubricant such as calcium stearate is preferably added to and mixed with the rapidly solidified rare-earth alloy magnetic powder yet to be compacted.

FIG. 1 is a cross-sectional view schematically illustrating the configuration of an ultrahigh pressure powder press machine that can be used effectively in a preferred embodiment of the present invention. The machine shown in FIG. 1 can make a uniaxial press on a powder material 2, which has been loaded into a cavity, under high pressures. The machine includes a die 4, of which the inner surface defines the side surface of the cavity, a lower punch 6 with a lower pressurizing surface that defines the bottom of the cavity, and an upper punch 8 with an upper pressurizing surface that faces the lower pressurizing surface. The die 4, the lower punch 6 and/or the upper punch 8 are driven up and down by a driver (not shown).

In the state shown in FIG. 1(*a*), the top of the cavity is opened and the magnetic powder 2 is loaded into the cavity. Thereafter, by either moving down the upper punch 8 or moving the die 4 and the lower punch 6 up, the magnetic powder 2 in the cavity is compressed and compacted as shown in FIG. 1(*b*).

The die 4 and the upper and lower punches 8 and 6 may be made of cemented carbide or a powder high speed steel but may also be made of a high strength material such as SKS, SKD or SKH.

These high strength materials are hard but brittle. That is why if the press direction deviated albeit slightly, these materials would be broken easily. That is why to get the ultrahigh pressure compaction done in the present invention, the misalignment between the center axes and the tilt precision of the die 4 and the upper and lower punches 8 and 6 need to be 0.01 mm or less. If the axial misalignment or axial tilt were significant, then the upper and lower punches 8 and 6 would buckle and be broken under the ultrahigh pressure. The smaller the size of the compressed compact to make, the smaller the diameter of the shaft of the upper and lower punches 8 and 6 and the more serious such a problem gets.

Figure 2:
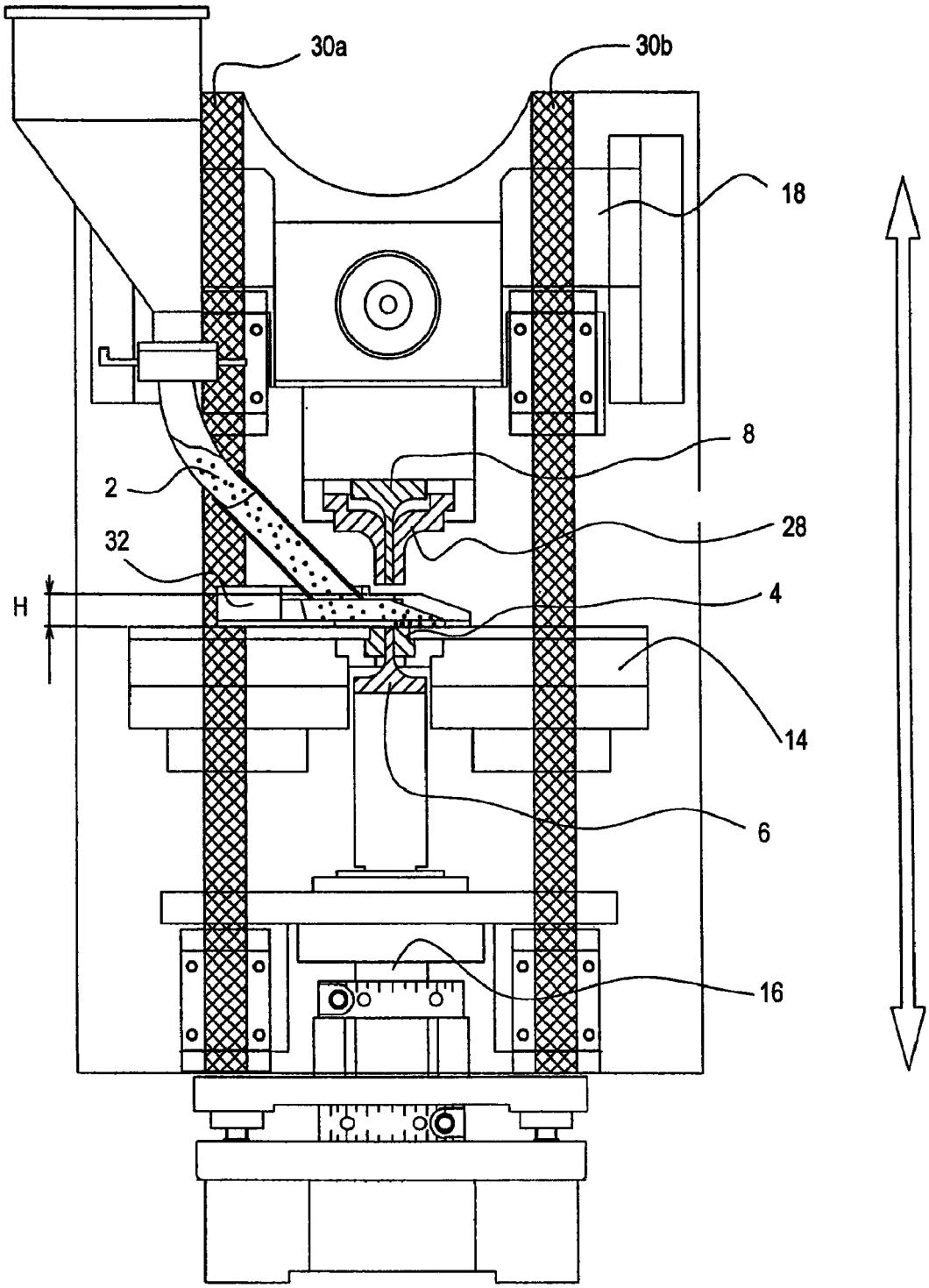
FIG. 2 shows an exemplary configuration for an ultrahigh pressure powder press machine that can be used effectively in a preferred embodiment of the present invention.

To prevent the upper and lower punches 8 and 6 from being broken and to carry out the ultrahigh pressure press process, which would be difficult to perform by a conventional technique, with good stability, the ultrahigh pressure powder press machine for use in this preferred embodiment preferably has a structure such as that shown in FIG. 2. Hereinafter, the configuration of the high-pressure powder press machine shown in FIG. 2 will be described.

In the machine shown in FIG. 2, a fixing die plate 14 fixes the die 4 thereon, and lower punch 6 is inserted into the through hole of the die 4. The lower punch 6 is moved up and down by a lower ram 16, while the upper punch 8 is reinforced with an upper punch outer surface reinforcing guide 28 and is moved up and down by an upper ram 18. The upper ram 18 is moved down and the bottom of the outer surface reinforcing guide 28 soon contacts with the upper surface of the die 4, when the upper punch outer surface reinforcing guide 28 stops lowering. However, the upper punch 8 continues to move further downward to enter the through hole of the die 4 eventually. By providing the upper punch outer surface reinforcing guide 28, the upper punch 8 can have its durability increased under the ultrahigh pressure.

This press machine further includes a pair of linear guide rails 30*a* and 30*b* that are arranged symmetrically to each other with respect to the center axis of the fixing die plate 14. The upper and lower rams 18 and 16 communicate with each other through the linear guide rails 30*a* and 30*b* and slide up and down on the rails. The press machine shown in FIG. 2 uses a feeder that moves straight and reciprocates back and forth very quickly, and therefore, the feeder cup 32 thereof can have a reduced thickness H. That is why when the upper punch 8 is retracted over the die 4, the gap between the upper punch 8 and the die 4 can be narrowed. The narrower this gap, the shorter the distance the upper punch 8 has to go up and down. As a result, axial misalignment and tilting, which will often be caused by vertical motions, can be reduced.

In a conventional powder press machine, the vertical slide axis of the upper ram and that of the lower ram are provided separately from each other, thus causing axial misalignment and axial tilting very often and achieving a precision of 0.04 mm. On the other hand, in the ultrahigh pressure powder press machine with the configuration shown in FIG. 2, the vertical motions of the upper and lower rams 18 and 16 are restricted by the linear guide rails 30*a* and 30*b*, and therefore, the axial misalignment and axial tilting can be reduced to a precision of 0.01 mm or less.

According to the results of experiments the present inventors carried out, the magnetic powder 2 is preferably compressed and compacted with a pressure of 500 MPa to 2,500 MPa applied thereto. To increase the volume fraction of the magnetic powder to the entire binderless magnet and improve the magnetic properties thereof, the pressure is preferably increased to at least 1,300 MPa, more preferably to 1,500 MPa or more, and even more preferably to 1,700 MPa or more. Meanwhile, considering the durability of the die and the mass-productivity, the pressure is preferably no higher than 2,000 MPa. If the pressure were lower than the lower limit specified above, then the binding force between the powder particles would decrease to make the mechanical strength of the compact insufficient and possibly crack or chip the magnet being handled. On the other hand, if the pressure during the compression and compaction process exceeded the upper limit specified above, then too much load would be placed on the die, thus making it difficult to apply this technique to mass production.

The compressed compact 10 obtained in this manner is then subjected to a heat treatment process. As a result of the heat treatment process, an ingredient coming from the magnetic powder of the rapidly solidified alloy is segregated from the surface of the magnetic powder particles and in their internal cracks and this segregated substance binds the respective particles together to turn the compressed compact into a binderless magnet. If the heat treatment temperature were lower than 350° C., then such an effect of segregating an ingredient coming from the magnetic powder of the rapidly solidified alloy and binding the particles together with this segregated substance would not be achieved. On the other hand, if the heat treatment temperature exceeded 800° C., then the crystal grains inside the magnetic powder particles that form the binderless magnet would grow too much to avoid deterioration in magnetic properties. For these reasons, the heat treatment temperature preferably falls within the range of 350° C. to 800° C., more preferably within the range of 400° C. to 600° C. The heat treatment process time depends on the heat treatment temperature but is typically within the range to five minutes to six hours.

If the magnetic powder particles of the compressed compact have amorphous phases, then the amorphous phases can be crystallized by the heat treatment process. Also, by using the heat generated by crystallization, a sintering process could be advanced even at low temperatures.

To prevent the compressed compact 10 from being oxidized during the heat treatment process, the heat treatment process is preferably carried out in an inert gas atmosphere. However, if even a small amount of oxygen or water vapor were contained in the inert gas, the compressed compact would be oxidized inevitably. That is why the partial pressures of oxygen and water vapor are preferably reduced as much as possible. For that purpose, the pressure of the heat treatment atmospheric gas is preferably reduced to $1\times10^{-2}$ Pa or less, and a dry gas with a dew point of −40° C. or less is more preferably used.

As a result of the heat treatment, a process similar to a sintering process will advance between the powder particles but no liquid phase will be produced unlike a rare-earth sintered magnet and the gaps will still be present between the particles. Also, if the heat treatment process is carried out after the compression/compaction process, the powder particles can be bound together to a higher degree and the resultant binderless magnet will have increased mechanical strength. If the heat treatment temperature is close to as high as 800° C., then a process similar to a sintering process will advance between the powder particles but no liquid phase will be produced unlike a rare-earth sintered magnet and the gaps will continue to be present between the particles. The heat treatment process is not an essential process to improve the properties of the magnet. However, to increase the mechanical strength of the binderless magnet to a practical level, the heat treatment process is preferably carried out after the compression/compaction process. Unlike the heat treatment process to be carried out simultaneously with the compression/compaction during the hot press process, the heat treatment process after the compression/compaction process may be carried out collectively on a lot of compressed compacts at the same time. In a conventional hot press process, a temperature raising/lowering cycle should be carried out every time a hot compression/compaction process is performed, thus taking a long time (of 10 to 60 minutes) to get a single compact. According to the present invention, however, the amount of time it takes to get the compression/compaction process done can be shortened to 0.01 to 0.1 minutes, which means that 10 to 100 magnets can be produced a minute. That is why even if the heat treatment process is added, the amount of time it takes to produce a predetermined number of binderless magnets hardly increases, thus realizing high mass-productivity.

Optionally, a powder of a low-melting metal may be added to, and mixed with, the magnetic powder of the rapidly solidified rare-earth alloy yet to be compressed and compacted. In that case, the low-melting metal powder to be added preferably has a particle size of 10 μm to 50 μm. The low-melting metal powder will melt between the magnetic powder particles during the low-temperature sintering process and will bind the powder particles even more tightly during the solid-phase sintering process in which the magnetic powder particles are bound together with a substance that has been segregated from the magnetic powder alloy. The low-melting metal powder may also cause the effect of entering and filling the gaps between the magnetic powder particles of the rapidly solidified rare-earth alloy. Or if the low-melting metal powder included in the compressed compact melted through the heat treatment, the metal powder would bond the magnetic powder particles together and increase the mechanical strength of the binderless magnet, too. The content of the low-melting metal powder is preferably adjusted to less than 15 wt %. This is because if the low-melting metal powder accounted for 15 wt % or more, the binding force between the magnetic powder particles might decrease.

The binderless magnet of the present invention is preferably compacted into a thin magnet or a thin ring magnet with a thickness of 0.5 mm to 3 mm or a magnet with a small diameter of ϕ2 mm to ϕ5 mm, including a ring magnet. A magnet with such a shape and such a size can have a uniform density inside the compressed compact. Thus, it is easy to prevent the magnetic properties of the binderless magnet from varying one site to another.

In the manufacturing process of the present invention, fractures are newly exposed on the surface and inside of the magnetic powder particles through the compression/compaction process under the ultrahigh pressure. If the heat treatment process is carried out even at a temperature of 800° C. or less after the compression/compaction process, an ingredient coming from the magnetic powder of the rapidly solidified alloy is segregated from the newly exposed fractures and those segregated substances bind the respective particles together. Since a solid-phase sintering process can be performed at such a low temperature, shrinkage and hot plastic deformation that would be caused by a high-temperature sintering process can be avoided. As a result, a magnet can be formed in a net shape with as great flexibility in shape and as high size precision as those of a bonded magnet. Also, the magnet can also be formed together with a yoke, a shaft or any other member.

Magnetic Circuit Component

Hereinafter, a preferred embodiment of a magnetic circuit component in which a rare-earth alloy based binderless magnet according to the present invention forms an integral part of a resin-less compressed powder magnetic core will be described. A resin-less compressed powder magnetic core made of a soft magnetic material powder may function as a soft magnetic member such as a yoke or a shaft. That is why this magnetic circuit component can be used effectively as a core member for a motor rotor.

To make such a magnetic circuit component, according to this preferred embodiment, the rare-earth alloy based binderless magnet and the resin-less compressed powder magnetic core are formed together by the ultrahigh pressure compression/compaction technique described above and a final product is obtained instead of completing the magnet and magnetic core separately and assembling them together. According to this method, the soft magnetic powder particles are also bound together by a sintering process without using a resin binder or any other binder. At the same time, the rare-earth alloy based binderless magnet and the resin-less compressed powder magnetic core are also combined together by the sintering process.

The formation process to be performed under the ultrahigh pressure (which will be referred to herein as a "final formation process") may be performed after a green compact of a rapidly solidified rare-earth alloy magnetic powder and a green compact of a soft magnetic material powder have been made and then arranged side by side in a press machine. Alternatively, the final formation process may also be carried out with one green compact completed but with the other still left as a powder.

Hereinafter, a method of making a magnetic circuit component according to this preferred embodiment will be described.

First, a magnetic powder of a rapidly solidified rare-earth alloy and a soft magnetic material powder are provided. The rapidly solidified rare-earth alloy magnetic powder may be made by the same method as that described above, while the soft magnetic material powder may be made by an atomization process, a reduction process or a carbonylation process or by pulverizing iron or an iron alloy. The soft magnetic material powder may have a mean particle size of 1 μm to 200 μm, for example.

Next, a green compact of the rapidly solidified rare-earth alloy magnetic powder and/or that of the soft magnetic material powder is/are made. As used herein, the "green compact" means an aggregation of powder particles yet to be subjected to the final formation process and may have a strength that is high enough to allow for handling. The powder may be compressed and compacted under a pressure of 100 MPa to 1,000 MPa, for example.

The final formation process may be carried out by one of the following three methods:

(1) A green compact of the rapidly solidified rare-earth alloy magnetic powder and a green compact of the soft magnetic material powder are both made, assembled together and then put into the die of a press machine. In this case, a die for final formation and a die for initial compaction may be provided separately and the green compact may be put into place in the die for final formation and then the final formation process may be carried out. Alternatively, the die that has been used to make one of the two types of green compacts may be loaded with the other type of green compact and then the final formation process may be carried out using the same die again;

(2) Either a green compact of the rapidly solidified rare-earth alloy magnetic powder or a green compact of the soft magnetic material powder is made and put into the die of the press machine. As a gap is left in the cavity space, the gap is filled with the powder that has not been compacted into a green compact. And then the final formation process is carried out. In this case, the dies for the initial compaction and the final formation may be the same or different from each other; and (3) These methods (1) and (2) may be combined with each other to make a magnetic circuit component in a complex shape.

Hereinafter, an example of the final formation process to be carried out in this preferred embodiment will be described with reference to FIG. 3.

Figure 3:
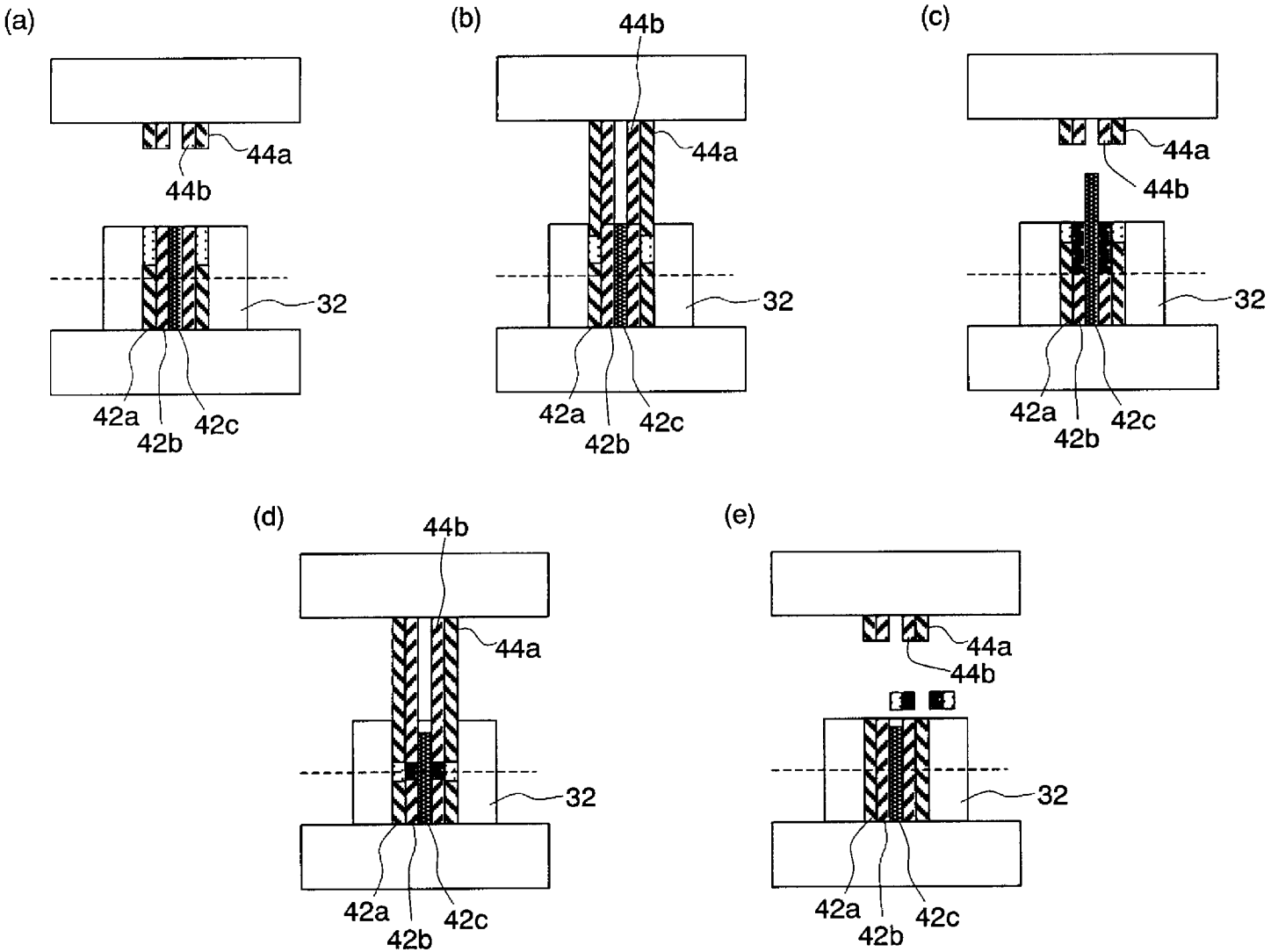
FIGS. 3(*a*) through 3(*e*) are cross-sectional views illustrating a preferred embodiment of a method of making a magnetic circuit component according to the present invention.

The multi-axis press machine shown in FIG. 3(*a*) basically has the same configuration as the high-pressure powder press machine shown in FIG. 2. However, the press machine of this preferred embodiment is different from that shown in FIG. 2 in that the punch has a double structure. More specifically, the machine shown in FIG. 3 includes a die 32 with a hole that defines a cavity in a predetermined shape, cylindrical lower punches 42*a* and 42*b* and upper punches 44*a* and 44*b* to be inserted into the hole of the die 32 and move up and down, and a center shaft 42*c*. The lower punch 42*a* and the upper punch 44*a* are used to compact the magnet portion under pressure, while the lower punch 42*b* and the upper punch 44*b* are used to compact the iron core portion under pressure.

In this preferred embodiment, a nanocomposite magnetic powder with a mean particle size of 50 μm to 200 μm is provided as the rapidly solidified rare-earth alloy magnetic powder and an iron powder with a mean particle size of 150 μm is provided as the soft magnetic material powder. 0.05 wt % to 2.0 wt % of calcium stearate is added to, and mixed with, the magnetic powder and the iron powder.

Next, after a cylindrical cavity space has been formed as shown in FIG. 3(*a*) by lowering the lower punch 42*a*, a magnetic powder is fed into this cavity. Thereafter, the upper punches 44*a* and 44*b* are lowered as shown in FIG. 3(*b*) and then the upper punch 44*a* is inserted into the cavity, thereby pressing the magnetic powder under a pressure of 100 MPa to 1,000 MPa and forming a green compact of the magnetic powder.

Subsequently, as shown in FIG. 3(*c*), the upper punches 44*a* and 44*b* are moved up and the lower punch 42*b* is moved down, thereby creating a cylindrical cavity space, which is then fed with the iron powder. Thereafter, as shown in FIG. 3(*d*), the upper punches 44*a* and 44*b* are lowered to press both the green compact of the magnet and the iron powder under a pressure of 500 MPa to 2,500 MPa. By compressing the green compact of the magnetic powder and the iron powder together in this manner, a compressed compact in which the magnet body portion and the soft magnetic member have been combined together can be obtained. In this process step, the shape of the integrally compressed compact can be controlled by adjusting the positions of the lower punches 42*a* and 42*b*.

Thereafter, as shown in FIG. 3(*e*), the lower punches 42*a* and 42*b* and the upper punches 44*a* and 44*b* are driven to unload the integrally compressed compact from the die 32. Finally, the compressed compact unloaded may be thermally treated at 500° C. for 40 minutes within a nitrogen atmosphere with a dew point of −40° C., for example. As a result of this heat treatment, the binding strength between the powder particles can be increased.

The integrally compressed compact thus obtained includes a binderless magnet portion in which the magnetic powder particles have been bound together without a binder and a soft magnetic member (i.e., the resin-less compressed powder magnetic core) in which the soft magnetic material powder particles have been bound together without a binder. And this compact has a structure in which the magnet body portion and the soft magnetic member are bound together without any bonding layer. In this compact, the soft magnetic member may have a density of 7.6 g/cm$^3$ (which is 98% of the true density), while the magnet body portion may have a density of 6.5 g/cm$^3$ (which is 87% of the true density), for example.

In the example described above, a green compact of a magnetic powder is made first, and then an iron powder is added and the ultrahigh pressure compression is carried out. However, the final formation process may also be carried out in any of various other manners as described above.

The magnetic circuit component obtained in this manner has not only the features of the binderless magnet of the present invention but also the following features as well:

(1) Since the binderless magnet and the soft magnetic member have both been made by a powder compaction process, the magnetic circuit component can be formed in any complex shape;

(2) The size precision of the magnetic circuit component of the present invention is defined by the precision of the die, and therefore, should be higher than that of a magnetic circuit component made by a normal cutting and bonding processes;

(3) As there is no need to perform the process step of bonding the binderless magnet and the soft magnetic member together, the number of manufacturing process steps can be reduced;

(4) The strain that has been created in the soft magnetic material during the compression can be relaxed by performing the heat treatment process after the integral compaction process. As a result, the coercivity resulting from the strain can be reduced. In a situation where the magnetic circuit of the present invention is used as a motor's rotor, if the hysteresis loss caused by the coercivity can be decreased, then the efficiency of the motor can be increased, which is particularly effective in making an IPM rotor that utilizes the reluctance torque of a soft magnetic member. It should be noted that if there were a resin binder, a high-temperature heat treatment that should be carried out to remove the strain could not be performed and the strain would be left; and (5) If an iron powder or an iron alloy powder that has a high sintered strength after a heat treatment process is selected as the soft magnetic material and if a structure in which the soft magnetic material surrounds a magnet is adopted, the mechanical strength can be increased compared to a situation where the magnet is provided by itself.

As the surface treatment that can be done on the rare-earth alloy based binderless magnet of the present invention, not just a resin coating that has been performed on a known bonded magnet but also a process of making a coating including a silicate salt and a resin as main ingredients as disclosed in Japanese Patent No. 3572040, a process of making an alkyl silicate coating in which metal fine particles are dispersed as disclosed in Japanese Patent Application Laid-Open Publication No. 2005-109421, a known conversion coating process, a known electroplating process and the metal coating process by vapor deposition may be adopted as well. However, it is difficult to perform the electroplating process on a bonded magnet including an electrically insulating binder. Also, the metal coating process by vapor deposition has a deposition temperature higher than the melting point of a binder resin, and therefore, is rarely applied to bonded magnets.

EXAMPLES

First, as magnetic powders, provided were a rare-earth-iron-boron (R—Fe—B) based isotropic nanocomposite magnetic powders SPRAX-XB, -XC and -XD produced by Neomax Company, an R—Fe—B based magnetic powder including an $Nd_2Fe_{14}B$ phase as a single magnetic phase (which will be identified herein by Ni) and R—Fe—B based isotropic nanocomposite magnetic powders including a hard magnetic $Nd_2Fe_{14}B$ phase and a soft magnetic α-Fe phase (which will be identified herein by N2 and N3). The following Table 1 shows the alloy compositions of these six types of magnetic powders and Table 2 shows the magnetic properties and average particle sizes of the magnetic powders themselves:

TABLE 1

| Magnetic | Alloy composition (at %) | | | | | | | |
|---|---|---|---|---|---|---|---|---|
| powder | Nd | Pr | Fe | Co | B | C | Ti | M |
| SPRAX-XB | 6.0 | 1.0 | 76.0 | — | 12.0 | 1.0 | 4.0 | — |
| SPRAX-XC | 9.0 | — | 73.0 | — | 12.6 | 1.4 | 3.0 | Nb1.0 |
| SPRAX-XD | 8.0 | — | 71.0 | 4.0 | 11.0 | 1.0 | 5.0 | — |
| N1 | 11.5 | — | 75.5 | 5.5 | 5.5 | — | — | Zr2.0 |
| N2 | 9.0 | — | 76.0 | 8.0 | 5.5 | 0.5 | 1.0 | — |
| N3 | — | 8.3 | 73.7 | 8.0 | 5.5 | 0.5 | 4.0 | — |

TABLE 2

| Magnetic powder | Remanence $B_r$ (mT) | Coercivity $H_{cJ}$ (kA/m) | Maximum energy product $(BH)_{max}$ (kJ/m$^3$) | Average particle size (μm) |
|---|---|---|---|---|
| SPRAX-XB | 831 | 653 | 101 | 90 |
| SPRAX-XC | 794 | 1,035 | 103 | 90 |
| SPRAX-XD | 877 | 783 | 115 | 90 |
| N1 | 928 | 925 | 132 | 90 |
| N2 | 973 | 593 | 132 | 90 |
| N3 | 1,007 | 541 | 136 | 90 |

Next, 0.5 outwt % of calcium stearate was added to, and mixed with, each of these magnetic powders. Thereafter, each magnetic powder was compacted to make a compressed compact from the magnetic powder. The compressed compact had an inside diameter of 7.7 mm, an outside diameter of 12.8 mm, and a height of 4.8 mm. The following Table 3 shows the compaction conditions of Examples #1 through #7 and Comparative Examples #1 through #4:

TABLE 3

| | Type of magnetic powder | Compaction method | Resin binder | Compacting pressure (MPa) |
|---|---|---|---|---|
| Ex. 1 | SPRAX-XB | Compression | None | 1,900 |
| Ex. 2 | SPRAX-XB | Compression | None | 580 |
| Ex. 3 | SPRAX-XC | Compression | None | 700 |
| Ex. 4 | SPRAX-XD | Compression | None | 1,900 |
| Ex. 5 | N1 | Compression | None | 1,900 |
| Ex. 6 | N2 | Compression | None | 1,900 |
| Ex. 7 | N3 | Compression | None | 1,900 |
| Cmp. Ex. 1 | SPRAX-XD | Compression | Epoxy resin | 900 |
| Cmp. Ex. 2 | SPRAX-XD | Compression | Epoxy resin | 900 |
| Cmp. Ex. 3 | SPRAX-XD | Injection molding | PPS | 220 |
| Cmp. Ex. 4 | SPRAX-XB | Injection molding | PA12 | 210 |

Examples #1 through #7 were compacted by performing a cold process (i.e., without heating the press machine) with the same machine and by the same method except that the pressure was different during the compression/compaction process. The compressed compacts representing the respective specific examples of the present invention were thermally treated for 10 minutes within a nitrogen atmosphere with a dew point of −40° C. at a temperature of 500° C. for Examples #5, 6 and 7 and at 800° C. for Example #4, thereby making binderless magnets.

Comparative Example #1

A magnetic powder SPRAX-XD was provided and then 98 wt % of the magnetic powder and 2 wt % of epoxy resin were stirred up by a kneader treatment to obtain a mixture of the magnetic powder and the epoxy resin. 0.5 outwt % of calcium stearate was further added to this mixture, which was then compressed and compacted under a pressure of 900 MPa, thereby making a compact.

Next, the compact thus obtained was thermally treated at 180° C. for 30 minutes within a nitrogen atmosphere with a dew point of −40° C. to make a bonded magnet.

Comparative Example #2

Although 98 wt % of magnetic powder and 2 wt % of epoxy resin were mixed in Comparative Example #1, 97 wt % of magnetic powder and 3 wt % of epoxy resin were mixed in this Comparative Example #2. Other than that, there was no difference between the methods of these two comparative examples.

Comparative Example #3

A magnetic powder SPRAX-XD was provided and then a mixture of 90 wt % of the magnetic powder and 10 wt % of PPS (polyphenylene sulfide) was extruded with a biaxial extruder. Thereafter, the workpiece was cut to an appropriate length to obtain pellet materials with dimensions ϕ3 mm×4 mm. And then these pellets were subjected to an injection molding process under the conditions including a resin temperature of 340° C., a mold temperature of 180° C., and an injection pressure of 220 MPa, thereby making a molded product (i.e., a bonded magnet) as Comparative Example #3.

Comparative Example #4

A magnetic powder SPRAX-XB was provided and then a mixture of 95 wt % of the magnetic powder and 5 wt % of polyamide (PA12) was extruded with a biaxial extruder. Thereafter, the workpiece was cut to an appropriate length to obtain pellet materials with dimensions ϕ3 mm×4 mm. And then these pellets were subjected to an injection molding process under the conditions including a resin temperature of 290° C., a mold temperature of 120° C., and an injection pressure of 210 MPa, thereby making a molded product (i.e., a bonded magnet) as Comparative Example #4.

As for specific examples of the present invention and comparative examples that were thermally treated as needed, the volume fractions of the magnetic powders and the densities of the compacts were measured. The results are shown in the following Table 4:

TABLE 4

| | Volume fraction (%) of magnetic powder | Compact density ($Mg/m^3$) |
|---|---|---|
| Example 1 | 87 | 6.5 |
| Example 2 | 78 | 5.8 |
| Example 3 | 78 | 5.8 |
| Example 4 | 87 | 6.5 |
| Example 5 | 87 | 6.5 |
| Example 6 | 87 | 6.5 |
| Example 7 | 87 | 6.5 |
| Cmp. Ex. 1 | 73 | 5.8 |
| Cmp. Ex. 2 | 74 | 5.8 |
| Cmp. Ex. 3 | 62 | 5.1 |
| Cmp. Ex. 4 | 70 | 5.5 |

Next, the magnetic properties and the thermal resistances of the respective compacts (i.e., binderless magnets and bonded magnets) were evaluated. The results are shown in the following Table 5. The thermal resistance was evaluated by determining whether or not each compact varied its shape when left in the air at 150° C. for 24 hours.

TABLE 5

| | Remanence $B_r$ (mT) | Coercivity $H_{cJ}$ (kA/m) | Maximum energy product $(BH)_{max}$ ($kJ/m^3$) | Thermal resistance (did shape vary?) |
|---|---|---|---|---|
| Example 1 | 725 | 644 | 80 | ○ |
| Example 2 | 628 | 622 | 60 | ○ |
| Example 3 | 613 | 1,017 | 62.5 | ○ |
| Example 4 | 741 | 751 | 80 | ○ |
| Example 5 | 788 | 898 | 92 | ○ |
| Example 6 | 827 | 569 | 90 | ○ |
| Example 7 | 856 | 519 | 95 | ○ |
| Cmp. Ex. 1 | 623 | 762 | 61.6 | X |
| Cmp. Ex. 2 | 624 | 757 | 63 | X |
| Cmp. Ex. 3 | 530 | 711 | 45 | ○ |
| Cmp. Ex. 4 | 575 | 573 | 50 | X |

In the rightmost column of Table 5, the open circle ○ means that the thermal resistance was good (i.e., with no shape variations) while the cross X means that the thermal resistance was bad (with some shape variations).

As can be seen from these results, the volume fractions of the magnetic powder were highest in Example #1, #4, #5, #6 and in which the compression/compaction process was carried out under the highest pressure, and best magnetic properties were achieved in Examples #1, #4, #5, #6 and #7. Also, even with no binder, each of these specific examples had sufficiently high mechanical strength and exhibited good properties as a magnet.

Figure 4:
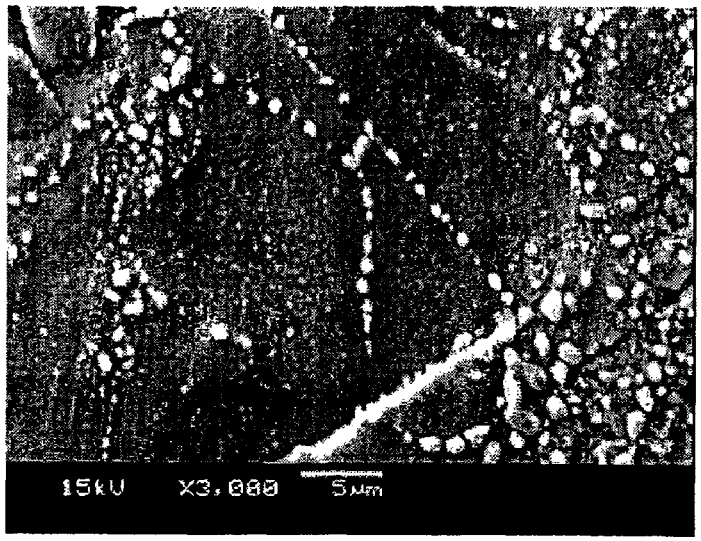
FIG. 4 is a cross-sectional SEM micrograph showing the inside of a powder particle according to a fourth specific example of the present invention.
Figure 5:
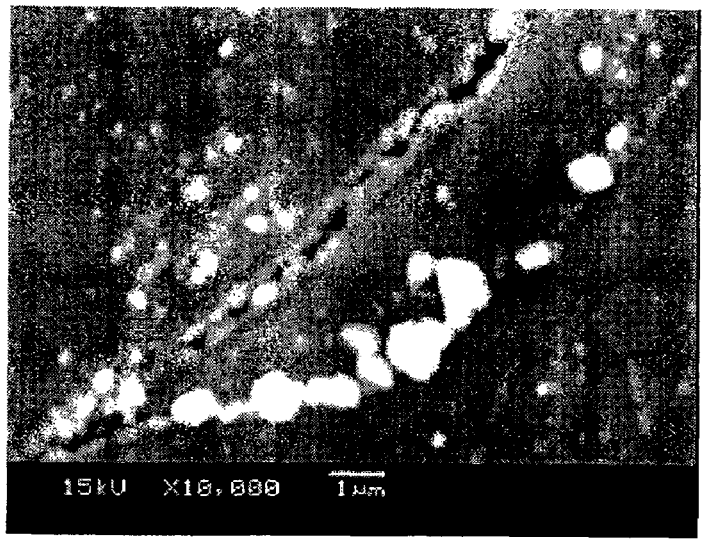
FIG. 5 is a cross-sectional SEM micrograph showing a portion between powder particles according to the fourth specific example of the present invention.

The sintered state of the magnet representing Example was observed. FIGS. 4 and 5 are SEM micrographs showing a cracked portion inside the magnetic powder and a portion between magnetic powder particles, respectively. As shown in FIG. 4, cracks were created inside the powder particle and had a lot of segregated portions (i.e., bright portions in FIG. 4). Segregated substances were also observed between the powder particles as shown in FIG. 5. According to the results of a composition analysis by EDS (energy dispersive X-ray spectroscopy), these segregated substances included Fe as its main ingredient.

Example #8

A magnetic powder was made out of flakes of a rapidly solidified alloy (with an average thickness of 25 μm and) having the alloy composition N2 shown in Table 1 and a compressed compact was obtained as Example #8 with the same machine and by the same method as those adopted in Examples #1 and #4 through #7. The dimensions of the compressed compact included an inside diameter of 7.7 mm, an outside diameter of 12.8 mm and a height of mm. The following Table 6 shows the average thicknesses of flakes of the rapidly solidified alloys, the mean particle sizes of pulverized powders, compaction conditions, and the densities of binderless magnets after the compressed compacts were thermally treated for Examples #8 and #6:

TABLE 6

| | Magnetic powder | Average thickness (μm) of rapidly solidified alloy flake | Mean particle size (μm) of powder | Compaction method | Resin binder | Compacting pressure (MPa) | Magnet density ($Mg/m^3$) |
|---|---|---|---|---|---|---|---|
| Ex. 8 | N2 | 25 | 90 | Compression | NO | 1,900 | 6.7 |
| Ex. 6 | N2 | 80 | 90 | Compression | NO | 1,900 | 6.5 |

If the mean particle size is the same, the smaller the average thickness of the rapidly solidified alloy flakes, the smaller the aspect ratio of the powder particles and the higher the degree of flatness. In Example #8, the powder particles had a flat shape with an aspect ratio of 0.3 or less. As can be seen from Table 6, the binderless magnet of Example #8 achieved a higher density than the counterpart of Example #6.

A binderless magnet according to the present invention includes no resin binder, has excellent thermal resistance, achieves a higher volume fraction than a bonded magnet, and therefore, can be used in various fields of applications as a replacement for a conventional bonded magnet.

Also, the binderless magnet of the present invention includes no resin, and can be easily subjected to a surface treatment such as plating. As a result, a magnet with good corrosion resistance can be obtained. Furthermore, since the magnet includes almost no non-magnetic materials such as a resin, only the magnetic powder can be easily extracted from the waste or defective products, thus providing good recyclability, too.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A method for producing a rare-earth alloy based binderless magnet, the method comprising the steps of:

(A) providing a rapidly solidified rare-earth alloy magnetic powder;

(B) compressing and compacting the rapidly solidified rare-earth alloy magnetic powder by a cold process at a temperature of 100° C. or less without using a resin binder, thereby obtaining a compressed compact, 70 vol % to 95 vol % of which is the rapidly solidified rare-earth alloy magnetic powder, wherein the rapidly solidified rare-earth alloy magnetic powder is compressed under a pressure of 500 MPa to 2,500 MPa; and (C) subjecting the compressed compact to a heat treatment process at a temperature of 350° C. to 800° C. after the step (B) has been performed.

2. The method of claim 1, wherein the step (C) includes conducting the heat treatment process within an inert gas atmosphere with a pressure of $1\times10^{-2}$ Pa or less.

3. The method of claim 1, wherein the step (C) includes conducting the heat treatment process within an inert gas atmosphere with a dew point of −40° C. or less.

4. A method of making a magnetic circuit component comprising:

a rare-earth alloy based binderless magnet in which magnetic powder particles of a rapidly solidified rare-earth alloy are bound together without a resin binder, wherein the magnetic powder of the rapidly solidified rare-earth alloy accounts for 70 vol % to 95 vol % of the entire magnet; and a resin-less compressed powder magnetic core in which powder particles of a soft magnetic material are bound together without a resin binder, wherein the binderless magnet and the resin-less compressed powder magnetic core are joined together, the method comprising the steps of:

(A) providing a rapidly solidified rare-earth alloy powder and a soft magnetic material powder;

(B) compressing the rapidly solidified rare-earth alloy powder and the soft magnetic material powder by a cold process at a temperature of 100° C. or less and under a pressure of 500 MPa to 2,500 MPa, thereby making a compact in which these two powders are joined together; and (C) subjecting the compressed and combined compact to a heat treatment process at a temperature of 350° C. to 800° C.

5. The method of claim 4, wherein the step (A) includes making a green compact of at least one of the rapidly solidified rare-earth alloy powder and the soft magnetic material powder, and wherein the step (B) includes compressing the rapidly solidified rare-earth alloy power and the soft magnetic material powder including the green compact at least partially.

* * * * *